US006241315B1

(12) United States Patent
Chiang

(10) Patent No.: US 6,241,315 B1
(45) Date of Patent: Jun. 5, 2001

(54) ROCKING CHAIR

(76) Inventor: Hsun-Cheng Chiang, 11F-2, No. 43 Chai-I Street, Taichung City (TW)

( * ) Notice: Subject to any disclaimer, the term of this patent is extended or adjusted under 35 U.S.C. 154(b) by 0 days.

(21) Appl. No.: 09/465,309

(22) Filed: Dec. 17, 1999

(51) Int. Cl.[7] ..... A47C 3/02
(52) U.S. Cl. ..... 297/259.3; 297/258.1
(58) Field of Search ..... 297/258.1, 259.3, 297/281, 273, 259.1

(56) References Cited

U.S. PATENT DOCUMENTS 5,427,433 * 6/1995 Holobaugh, Jr. .

5,536,099 * 7/1996 Ryan .

* cited by examiner

*Primary Examiner*—Milton Nelson, Jr.
(74) *Attorney, Agent, or Firm*—Charles E. Baxley

(57) ABSTRACT

A rocking chair includes a chair portion and a base portion which is located below the chair portion. The chair portion has two side panels extending from a bottom thereof and the base portion is located between the two side panels. Two pairs of Z-shaped connection members are pivotally connected between the base portion and the two side panels. A distance between the joint of the base portion and the connection members to the side panel is larger than the distance between the joint of the side panel and the connection members to the side panel.

4 Claims, 4 Drawing Sheets

ROCKING CHAIR

FIELD OF THE INVENTION

The present invention relates to a rocking chair that has no gap defined between the side panels and the connection members connected between the side panels and the base of the rocking chair when the chair is swung so as to prevent injury of limb accidentally inserted in the gap.

BACKGROUND OF THE INVENTION

A conventional rocking chair is illustrated in FIG. 1 and generally includes a chair portion 10 and base portion 14 which is pivotally connected to the chair portion 10 so that the chair portion 10 swings relative to the base portion 14. The chair portion 10 has two side panels 11, 12 and the base portion 14 is located between the two side panels 11, 12. The base portion 14 includes two I-shaped frames 15 with rods connected therebetween. Two pairs of connection members 13 respectively pivotally connected between the base portion 14 and the two side panels 11, 12. Each connection member 13 has a lower end 131 pivotally connected to the panel 11 or 12, and an upper end 130 of each connection member 13 pivotally connected to the base portion 14 as shown in FIG. 2. As shown in FIGS. 3 and 4, The chair portion 10 can be swung relative to the base portion 14 by pivoting the two pairs of connection members 13. It is to be noted that there will have a gap between the two connection members 13 and the two side panels 11 and 12. The gap generally is only 0.5 cm width. In other words, if a finger is accidentally inserted into the gap and when the side panels 11, 12 swing back, the finger will be injured. This could happen especially for kids playing around the rocking chair.

The present invention intends to provide a rocking chair that has no such dangerous gap exposed so as to prevent possible accidents happening.

SUMMARY OF THE INVENTION

In accordance with one aspect of the present invention, there is provided a rocking chair comprising a chair portion having a seat portion from which a backrest and two armrests extend. A first side panel and a second side panel respectively extend from a bottom of the seat portion. A base portion is pivotally connected to the first side panel and the second side panel of the chair portion by two Z-shaped first connection members and two Z-shaped second connection members. Each first connection member has a first joint end pivotally connected to the base portion and a second joint end pivotally connected to the first side panel. Each second connection member has a first joint end pivotally connected to the base portion and a second joint end pivotally connected to the second side panel. A distance between each first joint end of the first/second connection members to the first/second side panel is larger than a distance between each second joint end of the first/second connection members to the first/second side panel.

The object of the present invention is to provide a rocking chair wherein the distance between the end of each connection member connected to the base portion to the side panel is much larger than the distance between other end of each connection member connected to the side panel so that finger will not be cut when the finger is accidentally inserted between the side panel and the connection members.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
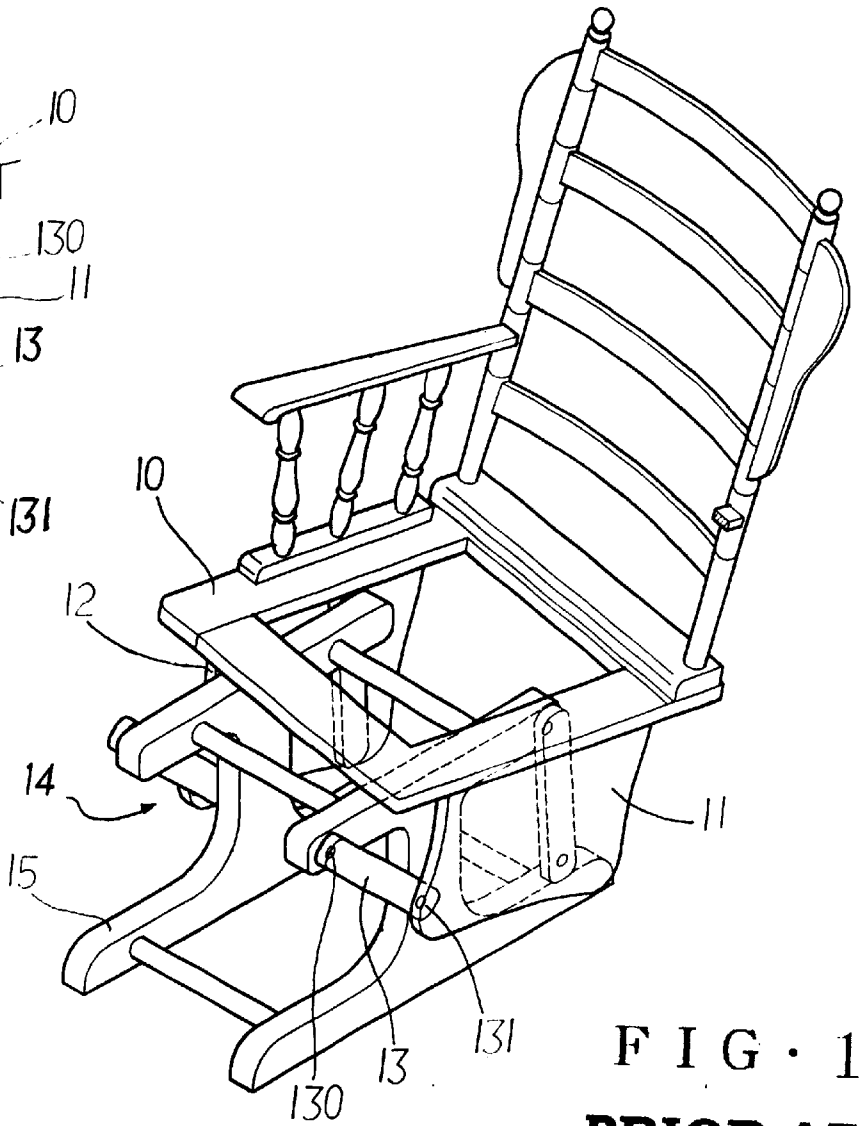
FIG. 1 PRIOR ART
FIG. 1 is a perspective view to show a conventional rocking chair.
Figure 2:
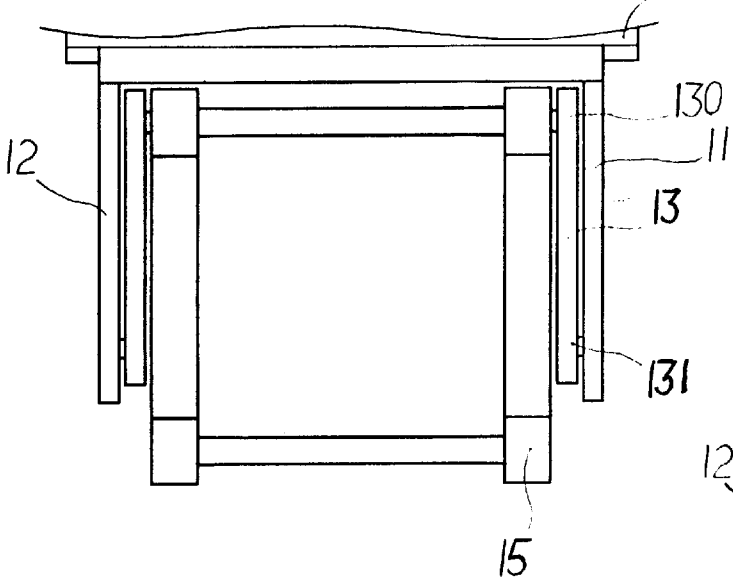
FIG. 2 PRIOR ART
FIG. 2 is an illustrative view to show the arrangement of the side panels of the conventional rocking chair, the base portion and the connection members.
Figure 3:
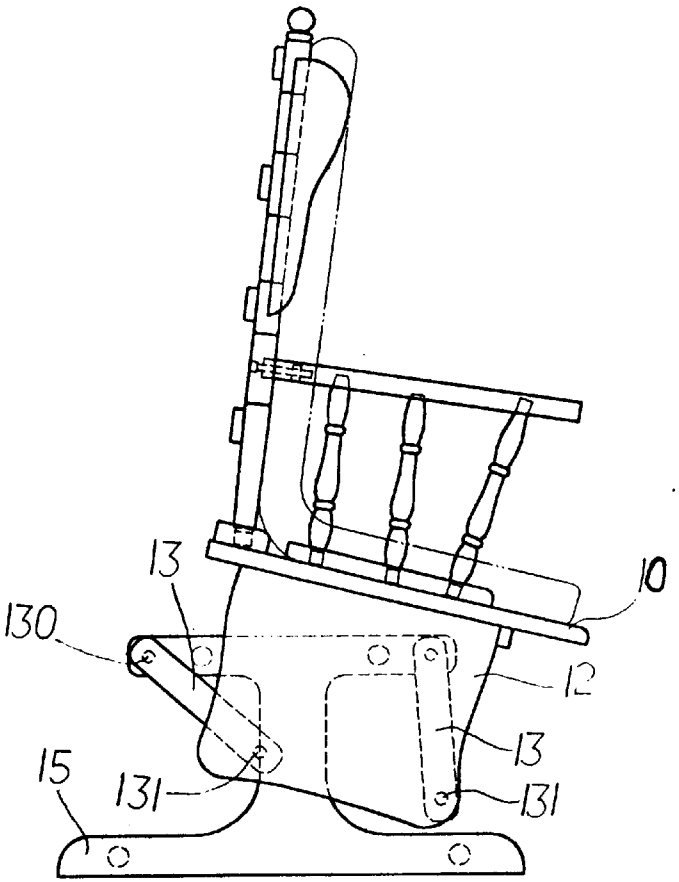
FIG. 3 PRIOR ART
FIG. 3 is a side view to show that the conventional rocking chair is swung toward and a gap is exposed between the side panel and the connection members.
Figure 4:
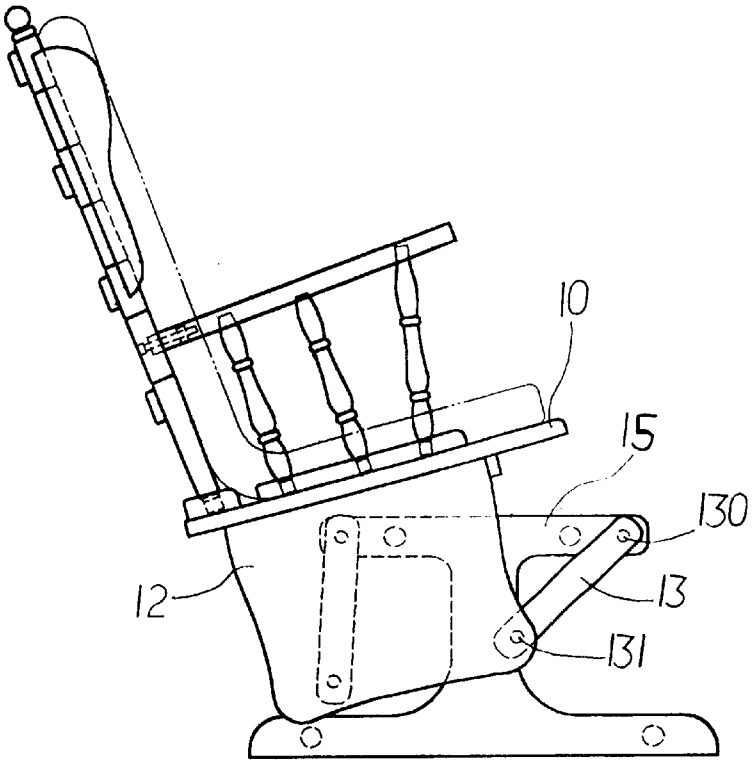
FIG. 4 PRIOR ART
FIG. 4 is a side view to show that the conventional rocking chair is swung backward and a gap is exposed between the side panel and the connection members.
Figure 5:
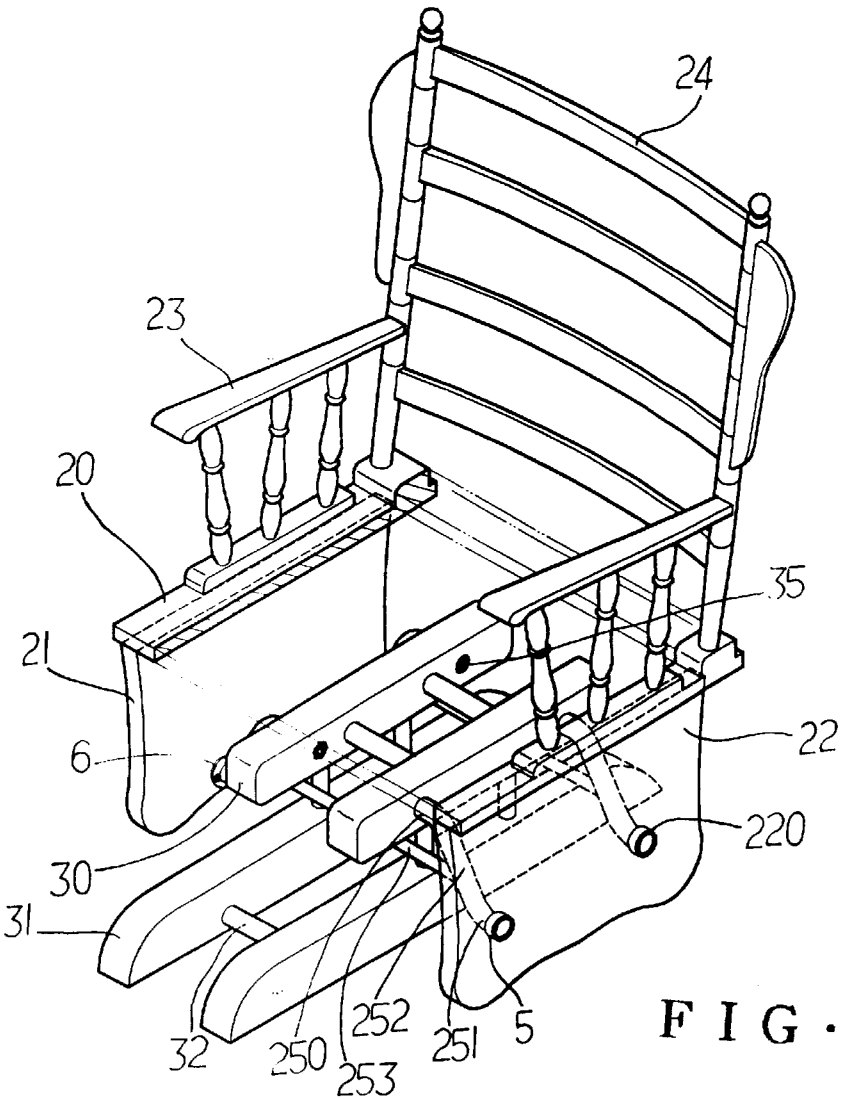
FIG. 5 is a perspective view to show a rocking chair in accordance with the present invention.
Figure 6:
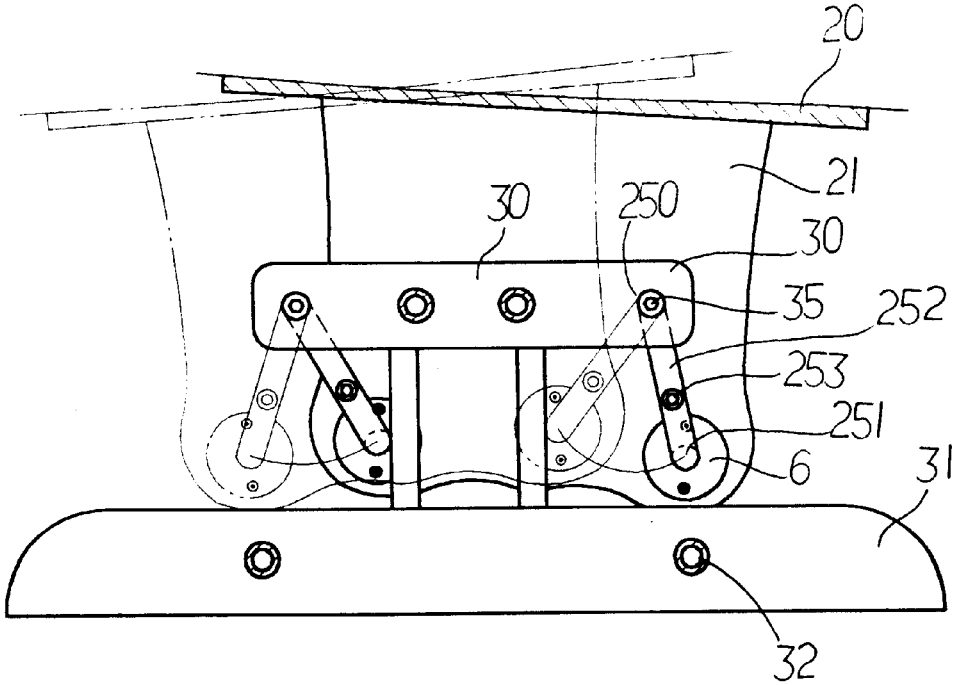
FIG. 6 is a side view to show the position of the side panels and the connection members when the chair is swung.
Figure 7:
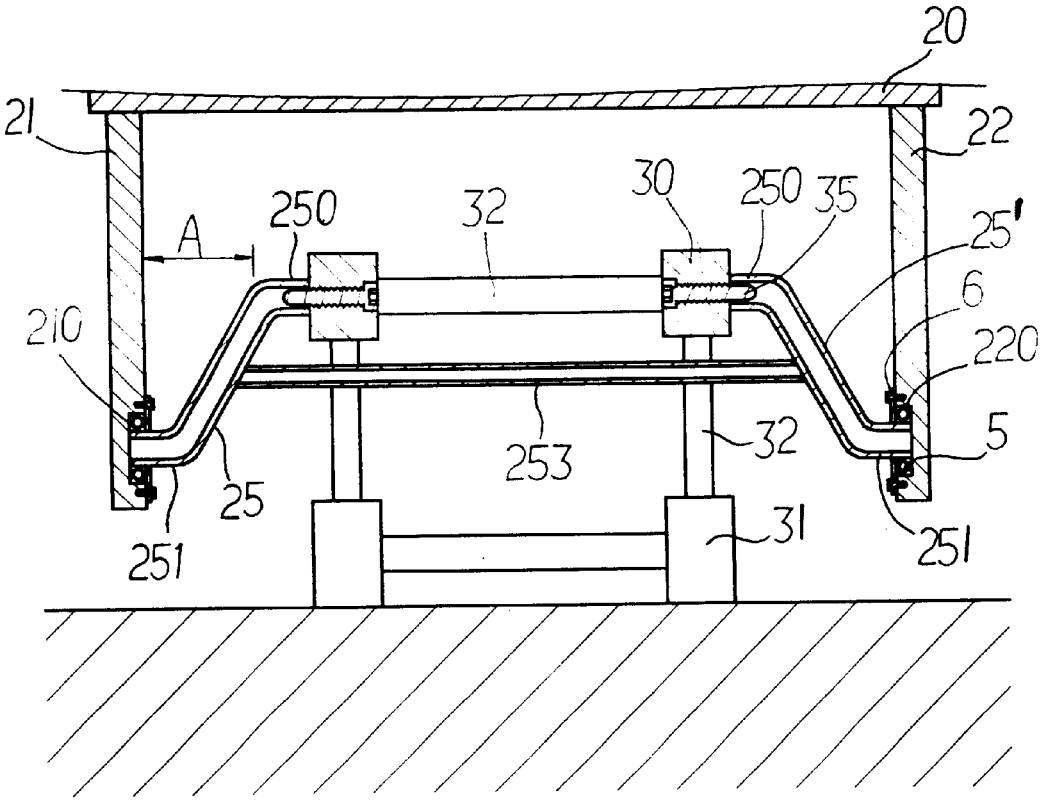
FIG. 7 is a cross-sectional view to show the arrangement between the side panels, the base portion and the connection members of the rocking chair in accordance with the present invention.

Referring to FIGS. 5 to 7, the rocking chair in accordance with the present invention comprises a chair portion having a seat portion 20 from which a backrest 24 and two armrests 23 extend. A first side panel 21 and a second side panel 22 respectively extend from a bottom of the seat portion 20. Each of the first side panel 21 and the second side panel 22 has two recesses 210/220 respectively defined in an inside thereof and a bearing 5 is engaged with each recess 210, 220 and positioned by a cap 6.

A base portion 30 is located between the first side panel 21 and the second side panel 22 of the chair portion. The base portion 30 includes two pairs of I-shaped frames 31 between which rods 32 are connected. A horizontal portion of each I-shaped frame 31 has two shafts 35 extending toward the two side panels 21, 22.

Two Z-shaped first connection members 25 each have a first joint end 250 and a second joint end 251. The first joint end 250 of each first connection member 25 is pivotally connected to the shaft 35 of the base portion 30, and the second joint end 251 of each first connection member 25 is pivotally connected to the first side panel 21 by engaging with the bearing 5. Two Z-shaped second connection members 25' each have a first joint end 250 and a second joint end 251. The first joint end 250 of each second connection member 25' is pivotally connected to the shaft 35 of the base portion 30, and the second joint end 251 of each second connection member 25' is pivotally connected to the second side panel 22 by engaging with the bearing 5 in the second side panel 22.

A distance between each first joint end 250 of the first connection members 25 to the first side panel 21 is much larger than a distance between each second joint end 251 of the first connection members 25 to the first side panel 21. Similarly, a distance between each first joint end 250 of the second connection members 25' to the second side panel 22 is much larger than a distance between each second joint end 251 of the second connection members 25 to the side second panel 22. The distance between each first joint end 250 of the first/second connection members 25/25' to the first/second side panel 21/22 is preferably at least 3 cm. An enforcement bar 253 is connected between each corresponding pair of the first connection member 25 and the second connection member 25'.

Therefore, because the distance between the connection members 25/25' and the side panels 21/22 is large enough so that even if a finger is accidentally inserted in the space, the finger will not be cut between the connection members 25/25' and the side panels 21/22. Accordingly, the rocking chair in accordance with the present invention is more safe and reliable.

While we have shown and described various embodiments in accordance with the present invention, it should be clear to those skilled in the art that further embodiments may be made without departing from the scope and spirit of the present invention.

What is claimed is:

1. A rocking chair comprising:

a chair portion having a seat portion from which a backrest and two armrests extend, a first side panel and a second side panel respectively extending from a bottom of said seat portion, each of said first side panel and said Second side panel having two recesses respectively defined in an inside thereof;

a base portion located between said first side panel and said second side panel of said chair portion, and two first connection members each having a first joint end and a second joint end, said first joint end of each first connection member pivotally connected to said base portion and said second joint end of each first connection member rotatably received in said recesses of said first side panel, two second connection members each having a first joint end and a second joint end, said first joint end of each second connection member pivotally connected to said base portion and said second joint end of each second connection member rotatably received in said recesses of said second side panel, a distance between each first joint end of said first connection members to said first side panel being larger than a distance between each second joint end of said first connection members to said first side panel, a distance between each first joint end of said second connection members to said second side panel being larger than a distance between each second joint end of said second connection members to said side second panel.

2. The rocking chair as claimed in claim 1, wherein said distance between each first joint end of said first/second connection members to said first/second side panel is at least 3 cm.

3. The rocking chair as claimed in claim 1 further comprising an enforcement bar connected between said first connection member and said second connection member.

4. The rocking chair as claimed in claim 1, wherein each of said first connection members and said second connection members are Z-shaped member.

* * * * *